United States Patent [19]

Gailey

[11] Patent Number: 5,050,360

[45] Date of Patent: Sep. 24, 1991

[54] SUSPENDED CEILING PANEL

[75] Inventor: J. Lynn Gailey, Clover, S.C.

[73] Assignee: Alcan Aluminum Corporation, Cleveland, Ohio

[21] Appl. No.: 510,482

[22] Filed: Apr. 18, 1990

[51] Int. Cl.[5] ..... E04B 9/00

[52] U.S. Cl. ..... 52/488; 52/781

[58] Field of Search ..... 52/489, 145, 781, 484, 52/780, 488, 473

[56] References Cited

U.S. PATENT DOCUMENTS

| | | | |
|---|---|---|---|
| 2,050,503 | 8/1936 | Ray . | |
| 2,817,752 | 12/1957 | Florence | 52/781 |
| 2,943,367 | 7/1960 | Wong | 52/488 |
| 3,021,915 | 2/1962 | Kemp | 52/145 |
| 3,213,585 | 10/1965 | Harry | 52/456 |
| 3,362,122 | 1/1968 | Schmitt | 52/584 |
| 3,977,144 | 8/1976 | Jahn . | |
| 4,541,216 | 9/1985 | Head . | |

*Primary Examiner*—John E. Murtagh

*Attorney, Agent, or Firm*—Calfee, Halter & Griswold

[57] ABSTRACT

A ceiling panel system for suspending a new and improverd ceiling panel from an assembly of inverted T-beam support members. The support members are suspended in a horizontal plane to form a desired grid pattern for supporting a plurality of ceiling panels to form a continuous ceiling. The T-beam support members comprise a vertical center leg having a pair of opposite horizontal arms, and a pair of opposite ribs projecting from the vertical center leg. The ceiling panel include a main body portion and integral resilient side walls. The side walls extend at an angle from body portion, and are adapted for captured engagement between the horizontal arms and ribs of the T-beam support members to resist removal of the panel from the support members. Each of the side walls includes a top edge spaced from said body portion having one or more slits extending transversely from the top edge toward the main body portion, to prevent the removal of the panel from captured engagement in the support members. The side walls of the ceiling panel additionally include first and second side edges which intersect the top edge, thus defining a ceiling panel with no closed corners for ease of manufacture, and a sixteen sided polygonal form in a top plan view.

13 Claims, 3 Drawing Sheets

SUSPENDED CEILING PANEL

TECHNICAL FIELD

This application relates to a system for suspending ceiling panels within a grid formed of inverted T-beam support members, and particularly to a special ceiling panel for resisting removal from the inverted T-beam support members. The suspended ceiling panel is simple and efficient to manufacture, easily installed within the support members, and difficult to remove from the support members once it is secured within the grid.

BACKGROUND

It is well known in suspended ceiling systems to suspend ceiling panels from a grid of inverted T-beam support members. The inverted T-beam support members extend downwardly from a permanent ceiling structure, and enable the ceiling panels to be suspended therefrom in spaced relation to the permanent ceiling structure. The suspended ceiling panels are typically supported from the grid of inverted T-members in edge-to-edge relation to form a continuous ceiling which conceals the supporting grid and the permanent ceiling structure from view. Preferably, the suspended ceiling is spaced sufficiently from the permanent ceiling structure to allow utility structure, such as pipes, duct work, electrical wiring, etc., to be conveniently located in the space between the suspended ceiling panels and the permanent ceiling structure.

There are many techniques for attaching or suspending ceiling panels from a grid of inverted T-beam support members. Some of these techniques utilize clips or wires to attach and detach the panels from the support members. Other methods support the ceiling panels from the inverted T-beam support members by simply resting each panel on the T-beam support members. In such systems the ceiling panels can be readily displaced by manual upward movement of the panel toward the permanent ceiling structure and out of engagement with the grid.

Another method for suspending ceiling panels is set forth in U.S. Pat. No. 4,541,216. In this system each panel or pan is seated within an opening formed in the grid by the inverted T-beam support members. The pans are supported on the support members, and maintained in position by engagement with overhanging ribs of the support members.

In correctional institutions, and other facilities requiring increased security, it is preferable to provide a suspended ceiling system with ceiling panels which are secured within the grid and cannot be removed by upward manual movement of the panel. Although systems using techniques as in U.S. Pat. No. 4,541,216 may be more effective than some prior methods used in such secure environments, the pans used by the system are difficult to manufacture, and are able to be removed from the grid by prying actions. Such prying actions are able to successfully remove the panels by applying a lever under one wall of the panel, and, by a "zipper" effect, running the lever along the full length of one side wall of the panel. Upon removal of one side of the panel, the remaining sides of the panel may also be removed by similar prying actions.

SUMMARY OF THE PRESENT INVENTION

The present invention provides a suspended ceiling system having panels which are simple to manufacture, and, when captured within a grid of inverted T-beam support members, are not readily removable, even upon attempts to remove the panel by prying actions. The ceiling panels are designed such that they can be installed relatively quickly and easily within the inverted T-beam support members, but cannot be readily removed from the support members by manual upward movement of the panel toward the permanent ceiling, or attempts to pry the panel from its captured position within the support members.

The suspended ceiling panels are supported on and locked within the grid of inverted T-beam support members which is suspended from a permanent ceiling structure. The support members are preferably arranged in spaced horizontal and perpendicular arrays to form the rectangular grid.

Each inverted T-beam support member has a substantially inverted T-shaped cross-sectional configuration. The T-shaped configuration includes a vertical or base leg having horizontal arms extending in opposite directions from the vertical leg. The horizontal arms preferably form shelves surrounding each cell or opening defined by the rectangular grid of support members. Additionally, overhanging ribs having ledge surfaces are formed on the vertical leg spaced from the horizontal arms, and projecting therefrom in opposite directions, one on each side of the vertical leg.

The ceiling panels of the system of the present invention may be formed of metal or plastic. The panels have substantially the same size and shape as the openings formed by the horizontal arms of the support members. The panels are formed with a flat main body portion and integral outwardly angled side walls having a top edge and two side edges. The height and angle of the side walls are designed so that the side walls may be resiliently engaged over the overhanging ribs. Once the side walls are resiliently moved over the overhanging ribs so that the top edges of the side walls engage the ledge surfaces formed on the ribs, the main body portion is then engaged with the horizontal arms, and the end of the panel is locked in captured engagement within the support members. In this captured position, removal of the panel by manual upward movement is prevented.

Removal of the panel by prying actions using a lever or other tool is prevented by the use of slits formed in the side walls of the panel. The top edge of each side wall includes one or more slits extending in a transverse direction from the top edge toward the main body portion. In the past, the removal of panels using a prying lever or other tool was assisted by the "zipper" effect. The "zipper" effect occurred when a prying lever was moved along the full length of one side wall of the panel, thereby prying and removing the entire side wall, and potentially the panel, from engagement with the support members.

By forming slits in the top edge of the side wall, a prying lever cannot be moved along the full length of the side wall. Instead, the slit or slits formed in the side wall divides the top edge into multiple sections. To remove the side wall from its position within the support member, each section of the top edge must be individually pried therefrom. Such multiple sections in the side wall "interrupt" the "zipper" effect during attempts to pry a panel from its position. Thus, the formation of slits in the panel side walls inhibits removal of the panels by prying actions, if not preventing it entirely.

Additionally, the ceiling panels of the present invention are simple to manufacture. The panels are formed without closed corners. Without closed corners, the top plan view of each panel typically has a sixteen sided polygonal-shape in its overall configuration. The elimination of closed corners simplifies manufacture of the panels, since the use of specially sized forming dies required for corner formation is no longer necessary.

Additional features of the present invention will be further apparent from the following detailed description and the accompanying drawings.

DETAILED DESCRIPTION OF THE PREFERRED EMBODIMENT

The present invention relates to a suspended ceiling panel system having ceiling panels which are easy to manufacture, and are configured to prevent removal of the panels from the support members.

Figure 1:
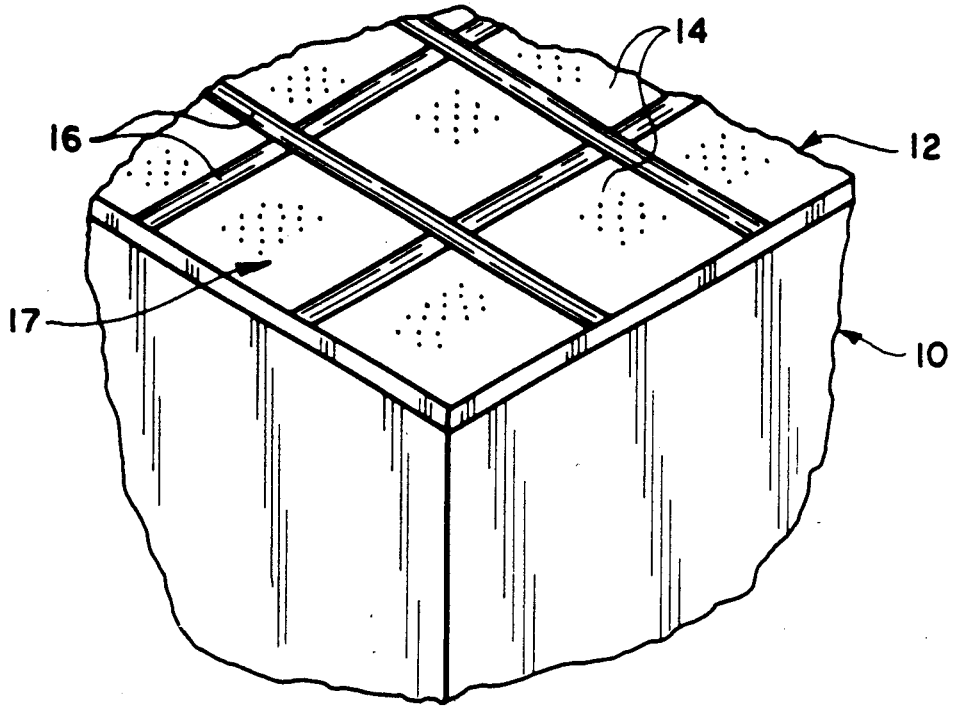
FIG. 1 is a partial perspective illustration of a room with a suspended ceiling system.
Figure 2:
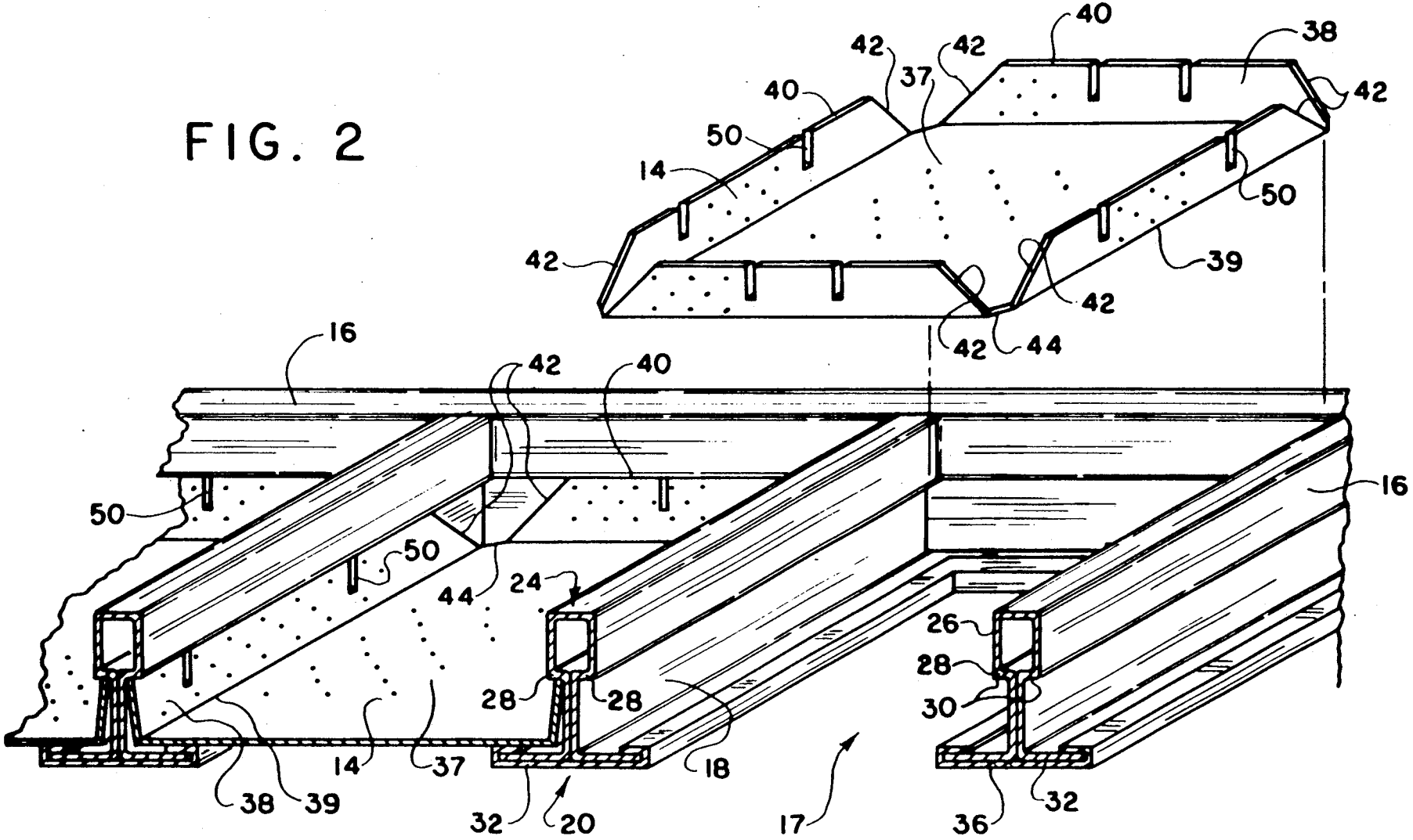
FIG. 2 is an exploded fragmentary perspective illustration of a suspended ceiling system having a grid of inverted T-beam support members with ceiling panels constructed in accordance with the present invention.

FIG. 1 of the drawings illustrates a room 10 with a suspended ceiling system 12. The suspended ceiling system 12 comprises a series of ceiling panels 14 suspended from a grid of inverted T-beam support members 16. The support members 16 are secured together in the rectangular grid pattern as illustrated in FIG. 2. The support members may be secured by any conventional means (not illustrated), and are supported from the permanent ceiling structure either directly, or by means of wires, or other conventional means (not illustrated). The means for interconnecting the support members, and connecting the support members to the permanent ceiling structure, are well known to those of ordinary skill in the art and require no further description.

The inverted T-beam support members 16 are arranged in spaced horizontal and perpendicular arrays to form a rectangular grid pattern, shown in part in FIG. 1. Typically, the grid pattern corresponds to the configuration of the ceiling panels to be suspended from the support members. Thus, when the ceiling panels have rectangular body portions, the inverted T-beam support members define corresponding rectangular openings 17. To complete the suspended ceiling system 12, a multiplicity of generally rectangular ceiling panels 14 are installed within each opening.

Figure 3:
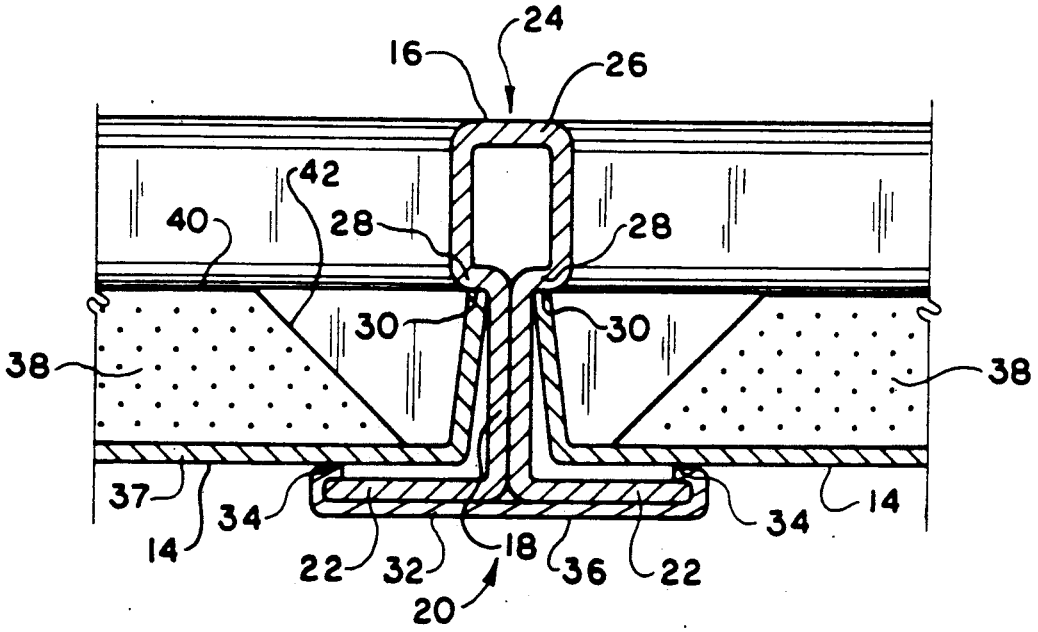
FIG. 3 is a fragmentary sectional view of an inverted T-beam support member with ceiling panels constructed in accordance with the present invention suspended therefrom.

Referring now to FIG. 2, the inverted T-beam support members 16 are suspended from the overhead permanent ceiling structure (not illustrated) so that the support members lie in a substantially horizontal plane. Each support member is similar in that it has an inverted T-shaped cross-sectional configuration. Specifically, as illustrated in FIGS. 2 and 3, the support members include a vertical or base leg indicated at 18. A lower end 20 of the vertical leg 18 terminates at a pair of horizontal arms 22 projecting from the vertical leg in opposite directions therefrom. When the ceiling panel 14 is positioned within the support members 16, the horizontal arms 22 are engaged with and support the ceiling panel. An upper end 24 of the vertical leg 18 includes a box rib 26 having a pair of overhanging ribs 28 which project laterally from opposite sides of the vertical leg. The overhanging ribs 28 project on opposite sides of the leg, and include ledge surfaces 30 for engagement with the ceiling panel 14.

As best illustrated in FIG. 3, the T-beam support members are formed by a metal strip which is roll formed to provide the box rib 26 at the upper end 24 of the vertical leg. The vertical leg 18 is formed by back to back layers of the metal strip. Single layers of the metal strip are turned outwardly away from one another to form the horizontal arms 22 at the lower end 20 of the vertical leg 18. It is additionally understood that the illustrated conventional roll formed metal strip could alternatively be formed as a unitary extruded member for heavy duty applications. In addition, the T-beam support members may have other cross-sections, provided that such sections include horizontal arms 22 at the lower end of the vertical leg 18 and overhanging ribs 28, or their equivalents.

As illustrated in FIGS. 2 and 3, a thin metal or plastic strip 32 is placed flush against the undersides of the horizontal arms 22. The strip 32 is wide enough so that its opposite edges 34 can be wrapped around and secured over the horizontal arms 22, to provide a finished surface 36 on the side of the support members 16 exposed to the room 10.

Referring to FIG. 3, each ceiling panel 14 includes a main body portion 37 and side walls 38 integral with the body portion and extending away from the main body portion at an angle thereto. The main body portion 37 defines the visible portion of the ceiling panel 14 which is viewed from the room 10. The panels 14 of the preferred embodiment are formed of aluminum or steel sheet metal.

As best shown in FIG. 2, the integral side walls 38 extend upwardly and outwardly to form a pan having no closed corners. In the prior art, the the term "rectangular pan" is used to reference ceiling panels generally. Typically, the walls 38 are at an angle of from about 5° to 10° from an angle perpendicular with the main body portion 37. The dimensions of the panels 14 are designed to fit within the grid openings 17 formed by the support members 16.

Each side wall 38 has the shape of an acute trapezoid and includes a top edge 40 and side edges 42. The top edge 40 is spaced from, and parallel with, the portion 39 of the side wall 38 integral with the main body portion 37. The panel 14 has no closed corners, and is designed such that the side edges 42 intersect the top edge 40 at an angle transverse with respect thereto. Intermediate the side edges 42 of adjacent side walls of the panel is an optional corner edge 44. Each corner edge 44 is formed in the same plane as the side edges 42 adjoining the corner edge. Thus, as illustrated in FIG. 4, the top and side edges 40, 42 of the side walls 38 define a sixteen sided polygonal form as viewed from a top plan view.

Figure 4:
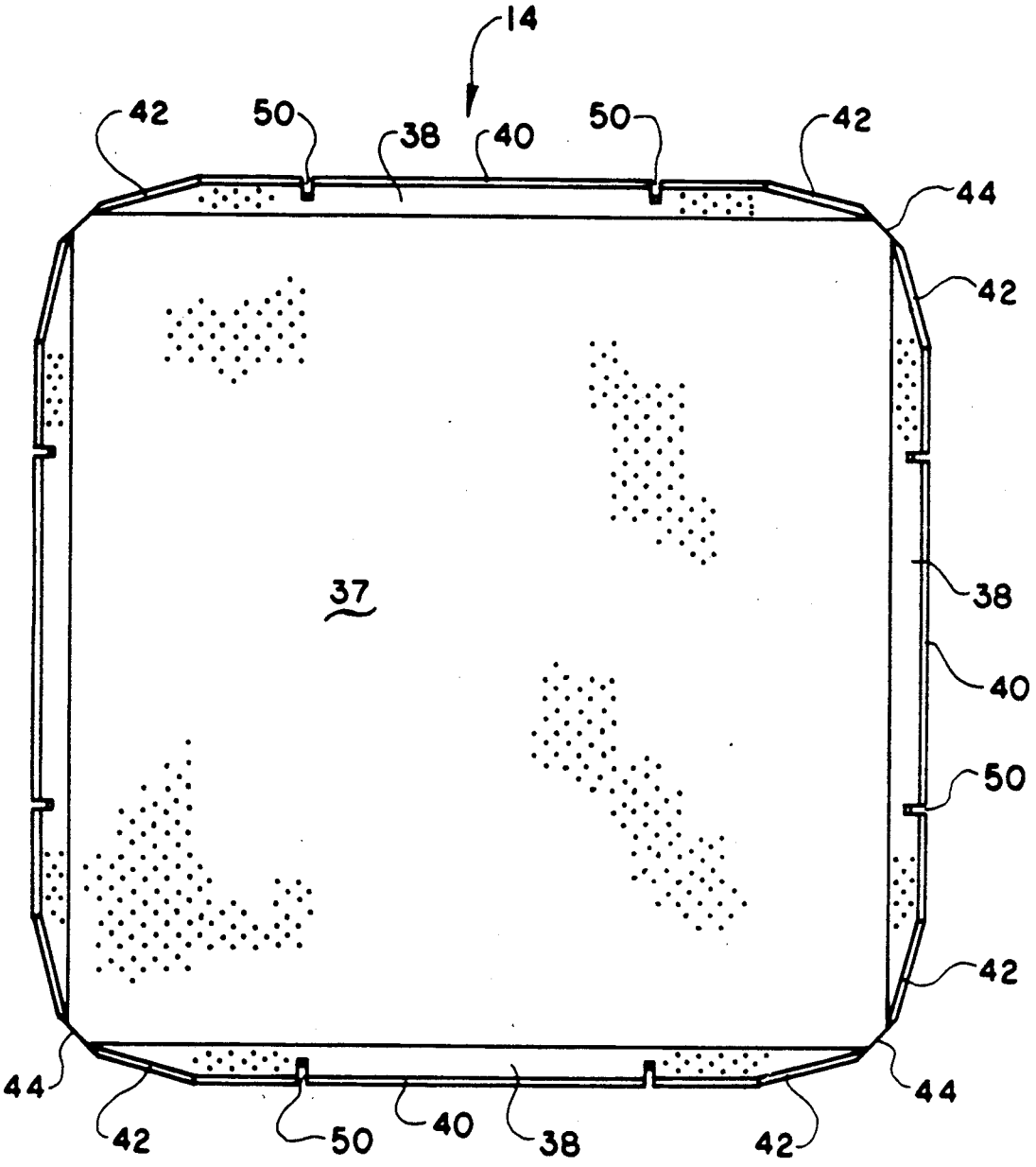
FIG. 4 is a top plan view of a ceiling panel constructed in accordance with the present invention.

Using the preferred corner-less panel configuration shown in FIG. 4, the panel is manufactured using a flat octagonal metal blank. The blank is stamped to form the integral side walls 38 using a forming die having the shape desired for the main body portion 37. Since the panel has no closed corners, the forming die need not be specially configured to accommodate the formation of closed corners.

As illustrated in FIGS. 2 and 4, each side wall 38 further includes one or more slits 50 formed in the top edge 40 of the panel side wall. The slits 50 extend from the top edge, and at an angle transverse thereto, toward the portion 39 of the side wall integral with the main body portion. As previously stated, the formation of one or more slits 50 divides the top edge 40 of the side wall 38 into multiple sections. The slits 50 can be of any desired dimensions, but should extend toward portion 39 through a substantial portion of the side wall 38 in order to interrupt the "zipper" effect previously described.

To install the panels 14 and complete the ceiling system 12, each panel is dropped from a position above the support members 16 into one opening 17. The panel may then be manually pushed downwardly toward the horizontal arms 22. The outwardly directed side walls 38 resiliently engage the box ribs 26, and are moved past the overhanging ribs 28 and into engagement with the vertical legs 18 and ledge surfaces 30 surrounding the opening 17.

The height of the side walls 38 of the panel is related to the distance intermediate the ledge surfaces 30 and horizontal arms 22, such that when the main body portion 37 is engaged with the horizontal arms, the top edges 40 of the panel side walls just clear the ledge surfaces. Since the panel side walls 38 are resilent, as soon as the panel seats on the arms 22, the top edges 40 of the side walls spring out to engage and be retained against the vertical legs 18 and the ledge surfaces 30 of the overhanging ribs 28. In this position, the panel is difficult to remove by manual movement in the upward direction toward the permanent ceiling structure.

Additionally, removal of the panel by prying actions is prevented by the use of the slits 50 formed in the top edges 40 of the side walls 38. When the slits 50 of the preferred embodiment are used in the top edges 38, the side walls cannot be pried from their position using the advantage of the "zipper" effect, or a lever inserted under the horizontal arms and slid along the top edges to remove the side walls from the support members. Instead, each section of the slitted top edges must be individually pried from their position within the support members to remove the side walls. Thus, the slits effectively "interrupt" the "zipper" effect, and resist removal of the panel from the support members by prying actions.

As seen in FIG. 1, when a number of panels 14 are seated within the openings 17 formed by the support members 16, the resulting suspended ceiling system 12 completely covers the permanent ceiling structure in the room 10, and presents an attractive decorative ceiling surface. It is understood that the panels 14 may have different surface treatments, including different colors to form a checkerboard, or other desired design.

Accordingly, the present invention provides a simple and efficient suspended ceiling panel system for suspending and securing specialized ceiling panels from a grid of inverted T-beam support members. With the principles of the present invention in mind, it is believed that various obvious modifications will be apparent to those of ordinary skill in the art.

I claim:

1. A suspended ceiling panel system comprising:

a) an assembly of inverted T-beam support members suspended in a horizontal plane to form a desired grid pattern, and a plurality of ceiling panels for engagement within said assembly to form a substantially continuous ceiling;

b) said T-beam support members comprising a vertical center leg terminating at a lower end by a pair of oppositely directed horizontal arms and having a pair of oppositely directed ribs projecting from an upper end of said vertical center leg;

c) said ceiling panel including a main body portion and integral resilient side walls extending at an angle from said body portion and adapted for captured engagement between said horizontal arms and ribs of said T-beam support members; and d) each of said side walls having a top edge spaced from said body portion including at least one elongate slit located intermediate spaced ends of said top edge extending transversely from said top edge toward said main body portion to resist removal of said panel from captured engagement with said support members.

2. A system as set forth in claim 1 wherein the top edge of said body portion includes two slits extending transversely from said top edge toward said main body portion to resist removal of said panel from captured engagement with said support members.

3. A system as set forth in claim 2 wherein said side walls of said ceiling panel each include first and second side edges intersecting said top edge at an angle transverse thereto, and said ceiling panel having a sixteen sided polygonal form in top plan view.

4. A system as set forth in claim 1 wherein said ceiling panel is formed of aluminum, and said side walls are integrally formed with said main body portion.

5. A system as set forth in claim 1 wherein said ceiling panel is formed of steel, and said side walls are integrally formed with said main body portion.

6. An apparatus comprising a ceiling panel for a suspended ceiling panel system, and being adapted for resisting removal from said system, said panel having a main body portion and resilient side walls connected with the main body portion and extending at an angle therefrom, each of said side walls having a top edge spaced from said main body portion and side edges intersecting said top edge and transverse with respect to said top edge, said top edge further including at least two closely spaced side wall sections extending between said side edges to resist removal of said panel from said system, and said ceiling panel having a sixteen sided polygonal form in top plan view.

7. An apparatus as set forth in claim 6, wherein said closely spaced side wall sections are separated by an elongate slit extending from said top edge toward said main body portion to interrupt a zipper effect.

8. An apparatus as set forth in claim 7 wherein said ceiling panel is formed of aluminum, and said side walls are integrally formed with said main body portion.

9. An apparatus as set forth in claim 8 wherein said ceiling panel is formed of steel, and said side walls are integrally formed with said main body portion.

10. A suspended ceiling panel system comprising:

a. an assembly of inverted T-beam support members suspended in a horizontal plane to form a desired grid pattern, and a plurality of ceiling panels for engagement within said assembly to form a substantially continuous ceiling;

b. said T-beam support member comprising a vertical center leg terminating at a lower end in a pair of oppositely directed horizontal arms, and at an upper end in a box rib, said box rib including overhanging ledge surfaces;

c. said ceiling panel including a main body portion and integral resilient side walls extending at an angle from said body portion and adapted for captured engagement between said horizontal arms and said ledge surfaces of said T-beam support members; and d. each of said side walls having the shape of an acute trapezoid and being attached to said main body portion along the longer of two parallel sides thereof.

11. A system as set forth in claim 10 wherein the top edge of said body portion includes at least one slit extending transversely from said top edge toward said main body portion to resist removal of said panel from captured engagement with said support members.

12. A system as set forth in claim 11 wherein said ceiling panel is formed of aluminum, and said side walls are integrally formed with said main body portion.

13. A system as set forth in claim 11 wherein said ceiling panel is formed of steel, and said side walls are integrally formed with said main body portion.

* * * * *